United States Patent [19]

Hastie

[11] Patent Number: 4,615,436

[45] Date of Patent: Oct. 7, 1986

[54] MAGNETIC RAZOR BLADE CONDITIONING DEVICE

[76] Inventor: John L. Hastie, 1455 A Raintree Way, Roswell, Ga. 30076

[21] Appl. No.: 823,979

[22] Filed: Jan. 30, 1986

Related U.S. Application Data

[63] Continuation of Ser. No. 691,425, Jan. 14, 1985, abandoned, which is a continuation of Ser. No. 430,431, Sep. 30, 1982, abandoned.

[51] Int. Cl.[4] ..... B65D 81/24

[52] U.S. Cl. ..... 206/208; 206/350; 206/352

[58] Field of Search ..... 206/350, 352, 208

[56] References Cited

U.S. PATENT DOCUMENTS

| | | | |
|---|---|---|---|
| 1,782,033 | 11/1930 | Forbes | 206/208 |
| 2,094,722 | 10/1937 | Sandford | 206/208 |
| 2,792,108 | 5/1957 | Keller | 206/208 |
| 3,352,630 | 11/1967 | Fischer et al. | 206/208 |
| 3,759,594 | 9/1973 | Cobb | 206/208 |

*Primary Examiner*—Joseph Man-Fu Moy
*Attorney, Agent, or Firm*—Jones & Askew

[57] ABSTRACT

A magnetic conditioning device whereby a magnetic influence acts upon a cutting edge, such as a razor blade, at an angle of substantially 45° incident thereto so as to maintain the sharpness of the cutting edge.

1 Claim, 4 Drawing Figures

MAGNETIC RAZOR BLADE CONDITIONING DEVICE

This application is a continuation of application Ser. No. 691,425, filed Jan. 14, 1985, which is a continuation of Ser. No. 430,431, filed 9/30/82, both now abandoned.

TECHNICAL FIELD

The present invention relates to extending the useful life of a cutting edge, and more particularly, relates to magnetically maintaining the sharpness of a razor blade.

BACKGROUND OF THE INVENTION

Various devices are known in the prior art to sharpen or maintain a cutting edge. In particular, devices have been described which purport to magnetically influence the cutting blade of a razor so as to restore and/or maintain the sharpness thereof. Examples of such devices include U.S. Pat. Nos. 1,775,518 and 1,782,033 to Forbes, and U.S. Pat. No. 2,321,570 to Billing. Other devices are known which purport to magnetically align the minute bends and distortions of the blade that occur as a result of normal usage of a razor. An example of such a device is U.S. Pat. No. 2,792,108 to Keller.

As evidenced by their lack of commercial exploitation, such devices have proven limited in scope and unacceptable. This lack of success stems from a difficulty in problem recognition. As noted by the prior art, the engagement of a razor's cutting edge to the epidermal surface results in a measured dulling of the blade. However, two other factors are of significance. The first factor concerns the interaction of the blade with its environment. A razor is conventionally stored in a bathroom or bathing area having a primarily hot and humid environment. The blade is thus subjected to a variety of corrosive forces. Secondly, a razor is infrequently cleaned and therefore, often stored within this corrosive environment without removal or rinsing of any residual matter therefrom. Thus, while the prior art contemplates the use of magnetic influence on a razor blade, it fails to consider these additional issues and hence, prior art devices have been found unacceptable. In short, therefore, the problem of maintaining the sharpness of a razor blade persists.

BRIEF DESCRIPTION OF THE INVENTION

The present invention solves the above described problem in the prior art by providing an improved magnetic conditioning device that maintains the sharpness of the cutting blade of a razor. In particular, the present invention recognizes those factors ignored by the prior art and provides a magnetic influence at an angle of 45° incident to the plane of the blade which is to be conditioned.

Generally described, the improved magnetic razor blade conditioning device of the present invention comprises a supporting body, a channel disposed within said supporting body comprising means for locating a razor blade in a predetermined position, and magnetic means whereby a magnetic influence acts upon a razor blade at an angle of 45° incident thereto so as to maintain the sharpness of the cutting edge.

Thus, it is an object of the present invention to provide an improved magnetic razor blade conditioning device that maintains and restores the sharpness of a razor blade.

It is a further object of the present invention to provide a magnetic razor blade conditioning device that contemplates the corrosive environment in which a razor is traditionally stored.

It is a still further object of the present invention to provide a magnetic razor blade conditioning device that contemplates the relative infrequency with which residual matter is cleaned from a razor blade.

It is a still further object of the present invention to provide a magnetic razor blade conditioning device that increases the useful life of a razor blade.

Other objects, features and advantages of the present invention will become apparent from reading the following specification when taken in conjunction with the following drawing.

DETAILED DESCRIPTION

Figure 1:
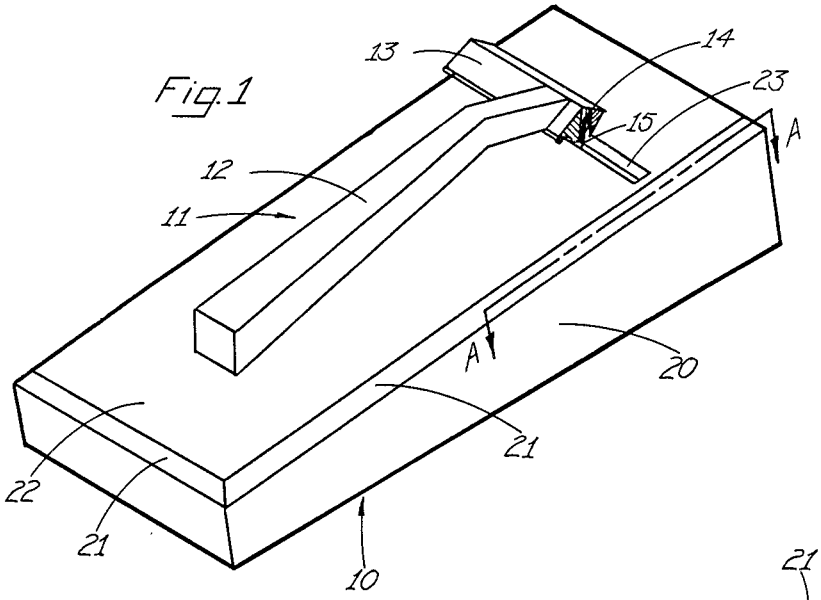
FIG. 1 is a pictorial view of an embodiment of the magnetic razor blade conditioning device according to the present invention, showing a fragmentary razor supported and kept in a proper predetermined location for magnetic conditioning.

Referring now in more detail to the drawing, in which like numerals indicate like parts throughout the several views, FIG. 1 shows a conventional razor 11 having a shaft-like handle 12 by which a user grips the razor, and a head 13 which further comprises a razor blade 14 having a cutting edge 15. The razor blade 14 is mounted within and projects outwardly from the razor head 13 so as to engage the cutting edge 15 thereof to the epidermal surface in the usual and well-known manner.

The razor 11 may be formed of any suitable material including plastic, metal or otherwise. A razor blade 14 is traditionally formed of a thin, flexible sheet of stainless steel, or other like material, having one or more edges specially treated so as to shave hair from the skin surface. It will be appreciated by those skilled in the art that a variety of razor handle and head configurations, such as single or double edge blades, are well known in the art and fully contemplated by the present invention.

FIG. 1 further shows a magnetic razor blade conditioning device 10 according to the present invention. The preferred embodiment comprises a rectangular supporting body 20 having a beveled side portion 21 and an upper surface 22. The supporting body 20 may be formed of any suitable non-ferrous material including wood, plastic, or otherwise. For example, the supporting body 20 may be potted in epoxy so as to provide a solid, unitary structure, impervious to water and therefore ideal for personal use as it would be easily cleaned, insusceptible to breakage, and otherwise easily cared for. The upper surface of the supporting body 20 is inclined in such a fashion as to support the razor 11 in an easily accessible position. The beveled edge 21 further aids the user in retrieving the razor 11 by eliminating sharp and angular corners, thereby directing the gripping action of the user toward the razor's handle 12.

The razor 11 is retained in a proper position by the locator channel 23. The locator channel 23 may be formed of any suitable non-ferrous material. Suitable materials include, but are not limited to, brass, plastic and wood. The locator channel 23 comprises a V-shaped trough, designed to conform to the head 13 of a razor 11. Alternative constructions could be provided. For example, the trough could be shown having a slight curvature so as to have a U-shape. It will be appreciated by those skilled in the art that the head 13 of the razor 11, when properly positioned, will be disposed within the locator channel 23. It will further be appreciated by those skilled in the art that the blade edge 15, as a result of the above-described construction of the locator channel 23, does not actually contract or otherwise engage the locator channel. When the razor 11 is so disposed, the handle 12 extends in a lengthwise manner perpendicular to the head 13 and the razor blade edge 15 extends parallel to the locator channel 23. Thus, the preferred embodiment contemplates a supporting body 20 of sufficient dimension to fully support a conventional razor 11. Since the primary purpose of the supporting body 20 is to place and retain the razor 11 in a predetermined location relative to the magnetic influence (discussed fully below), alternative constructions for supporting the razor could, of course, be provided.

Figure 2:
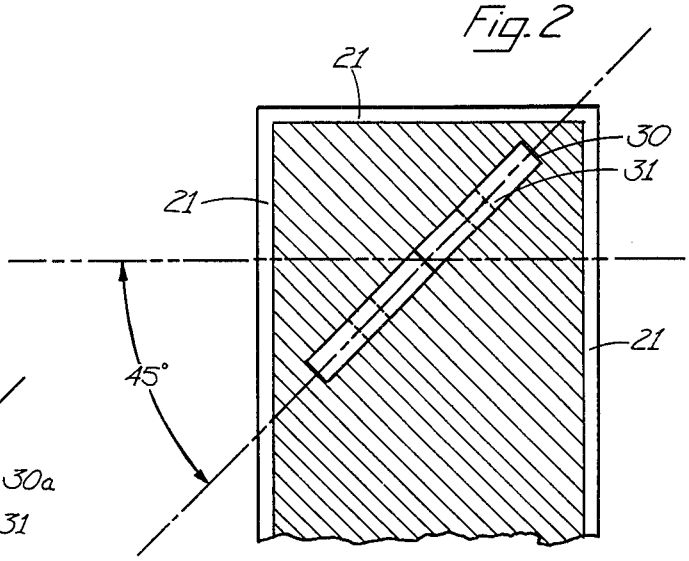
FIG. 2 is a top section view of the magnetic razor blade conditioning device shown in FIG. 1, taken along line A—A of FIG. 1, with a cutaway portion showing the orientation of the means of magnetic influence.
Figure 3:
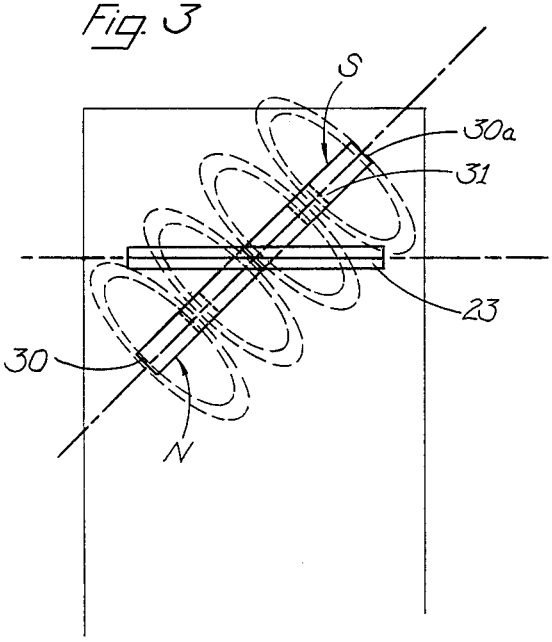
FIG. 3 is a top outline view of the magnetic razor blade conditioning device shown in FIG. 1, showing the orientation of the magnetic influence relative to the locator channel.
Figure 4:
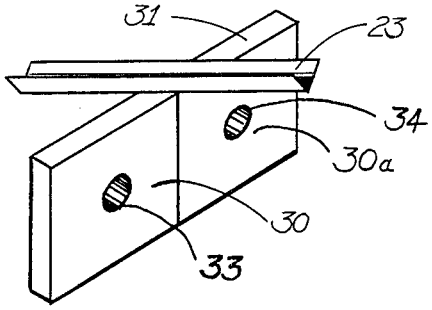
FIG. 4 is a cut-away side view of the magnetic razor blade conditioning device shown in FIG. 1.

Two magnetic members 30 and 30*a* are disposed in a parallel alignment within the supporting body 20. These permanent magnetic members 30 and 30*a* are pressed flush against the locator channel 23 (as best shown in FIG. 4) and positioned at an angle of 45° incident thereto (best shown in FIG. 2). Alternative constructions, wherein one or more magnetic members are provided, are fully contemplated by the present invention. The lines of magnetic flux are oriented and behave in the fashion as shown in FIG. 3. It is to be understood that the orientation of the present magnetic field differs significantly from that of a conventional bar magnet. The poles of a conventional bar magnet are located at the furthermost ends thereof. The preferred embodiment, however, comprises two permanent, rectangular magents having poles positioned along the longitudinal faces of the magnets. The novel arrangement of the present invention so locates the poles of the magnet as to place the lines of magnetic force in a substantially vertical plane (best shown in FIG. 3). The preferred embodiment further provides two apertures 33 and 34 within the magnetic members 30 and 30*a*, respectively. The apertures 33 and 34 serve to concentrate the magnetic field about those apertures, thereby imparting a greater field strength to the area of the locator channel 23. Such magnets are known in the art and commercially available. It has been determined, as discussed more fully below, that such an arrangement yields significant and unexpected results.

In operation, it is best to begin with an unused razor blade 14. The epidermal surface is prepared for shaving in any usual and well known manner. The use of the razor 11 is also performed in the usual and well known manner. Upon conclusion, the razor 11 should be rinsed, to a reasonable degree, of hair stubble and associated shaving residue. The razor head 13 is then placed within the locator channel 23 as described above until further use is required. The magnetic razor blade conditioning device 10 of the present invention will thusly restore and maintain the sharpness of the razor blade 14 to a degree unknown in the prior art.

The precise mechanism whereby such unexpected results are obtained is, in large part, unknown. However, it has been determined that the novel 45° alignment of the magnetic members 30 and 30*a* relative to the locator channel 23 (in which the razor blade 14 is retained) is at the root of such results.

Briefly explained, it is thought that the dulling of a razor blade occurs as as result of three factors. First, dulling occurs through normal usage of the razor, namely, due to cutting action. Secondly, a blade dulls from oxidation of the steel blade as a result of its exposure to the atmosphere when not in actual use. This oxidation is accelerated by the typical hot, humid bathroom environment. Thirdly, such corrosion of the blade is aided by the failure of the user to fully remove residual material. To retard such dulling of the blade, the present invention presents a novel application of a well known magnetic principle: any ferrous material brought into the vicinity of the magnetic members 30 and 30*a* will be attracted to the poles thereof along the lines of the magnetic field. The crystalline structure of the stainless steel razor blade 14 is thereby aligned at the unique angle of 45° as a result of the novel orientation of the magnetic poles. It is suspected that such a unique polarization of the micro-structure inhibits the normal oxidation process that occurs whenever ferrous metal objects, i.e., blade edge 15, are exposed to oxygen, and thus maintains the sharpness of the blade-edge to a degree previously unknown in the prior art.

It will be thus seen that a device embodying the present invention enjoys many advantages over prior art devices. The present invention is much easier and more economical to construct and maintain. The present device, as a result of the novel orientation of the magnetic influence relative to the plane of the blade to be conditioned, enhances the useful life of a razor to an extent heretofore unknown and unprovided in the prior art. Although the preferred embodiment of the present invention has been described in the context of razor blades, it is to be understood that the disclosed concepts have application to extending the useful life of any cutting blade capable of magnetic conditioning.

While I have described my invention in detail with particular reference to preferred embodiments thereof, it will be understood that variations and modifications can be effected within the spirit and scope of the invention as described hereinbefore and as defined in the appended claims.

I claim:

1. A magnetic conditioning device for a razor blade comprising:

a supporting body;

a channel disposed within said supporting body comprising means for locating a razor blade in a predetermined location; and means for creating a magnetic field having lines of magnetic flux intersecting said channel at an angle of substantially 45°, whereby a magnetic influence acts upon a razor blade retained within said channel locating means at an angle of substantially 45° incident thereto so as to maintain the sharpness of said razor blade.

* * * * *